United States Patent [19]

Breslow et al.

[11] 4,230,317

[45] Oct. 28, 1980

[54] SOUND ACTUATED COMPETITIVE GAME APPARATUS

[75] Inventors: Jeffrey D. Breslow, Highland Park; Alan A. Hicks, Chicago; Eugene Jaworski, Park Ridge; Burton C. Meyer, Downers Grove, all of Ill.

[73] Assignee: Marvin Glass & Associates, Chicago, Ill.

[21] Appl. No.: 876,406

[22] Filed: Feb. 10, 1978

[51] Int. Cl.[3] ..... A63D 3/02; H01H 35/24

[52] U.S. Cl. ..... 273/119 A; 46/256; 200/61.01; 340/148

[58] Field of Search ..... 124/32, 34; 273/119 A, 273/85 A, 129 R, 121 A, 122 A; 340/148; 179/1 VC; 46/256; 200/61.01

[56] References Cited

U.S. PATENT DOCUMENTS

| | | | |
|---|---|---|---|
| 1,279,831 | 9/1918 | Berger | 340/148 |
| 2,957,957 | 10/1960 | Johnson | 46/256 |
| 2,974,441 | 3/1961 | Denner | 46/256 |
| 2,995,866 | 8/1961 | Johnson | 46/256 |
| 3,012,365 | 12/1961 | Kretzmer | 46/256 |
| 3,061,973 | 11/1962 | Oberdorf | 46/256 |
| 3,082,002 | 3/1963 | Goldfarb | 46/256 |
| 3,119,201 | 1/1964 | Brown | 46/256 |
| 3,142,132 | 7/1964 | Johnson | 46/256 |
| 3,192,460 | 6/1965 | Wolff et al. | 318/460 |
| 3,373,526 | 3/1968 | Parkin | 340/148 |
| 3,458,950 | 8/1969 | Tomaro | 46/256 |
| 3,568,199 | 3/1971 | Hartness | 124/34 X |
| 3,624,962 | 12/1971 | Sykes | 46/256 |
| 3,664,060 | 5/1972 | Longnecker | 46/256 |
| 3,675,927 | 7/1972 | Gottlieb et al. | 273/119 A |
| 3,770,981 | 11/1973 | Nelsen | 124/32 |
| 3,961,441 | 6/1976 | Sato | 46/256 |
| 3,995,376 | 12/1976 | Kimble et al. | 273/101.1 |

FOREIGN PATENT DOCUMENTS

| | | | |
|---|---|---|---|
| 454453 | 2/1949 | Canada | 273/85 A |
| 593161 | 3/1959 | Italy | 273/119 A |

OTHER PUBLICATIONS

Experimental Telephone Lets Disabled "Dial" by Voice, Bell Lab Rec. (U.S.A.), vol. 51, No. 9, Oct. 1973, p. 272.

*Primary Examiner*—Richard T. Stouffer

*Attorney, Agent, or Firm*—Mason, Kolehmainen, Rathburn & Wyss

[57] ABSTRACT

A skill type game having a playing area and two goal areas at opposite ends of the playing area includes a sound actuated flipper at each goal area for selectively blocking and propelling a playing object. The game players control the operation of each of the flippers by shouting or emitting other sounds in an attempt to project the playing object into the other players goal area and prevent the playing object from entering his own goal area. The sound actuated flipper arrangement includes control circuitry to provide an automatic lockout feature to prevent sustained sounds from continually and/or continuously activating the flippers. The control circuitry of the sound actuated flipper arrangement provides a first predetermined time interval during which the flipper is operated and a second predetermined time interval within which operation of the flippers is inhibited. The playing area is defined by two relatively open areas each inclined upwardly from one of the goal areas to a center line. Each of the goal areas defines a first central opening for entrance of the playing object; the associated flipper defending the first goal opening when activated to prevent the entrance of the playing object into the associated goal area. Each of the goal areas also includes a second opening adjacent the first goal opening and a narrowed approach lane defined on the playing area. Accurate operation of the flippers propels a playing object directly into the second goal opening of the opposing goal area independent of the operation of the associated flipper.

12 Claims, 5 Drawing Figures

50
10
52
40
24
16b
16
18
22
26
28
30
14
16a
24
42
20
29
32
44
14b
36
34
29
30
26
14
112
14a
22
12
14b
96
28

56
50
20
16a
54
52
24
42
66
72
76
3
22
78
26
88
84
86
30
3
72
94
29
28
35
32
37
36
38
34
39
98
14b

SOUND ACTUATED COMPETITIVE GAME APPARATUS

BACKGROUND OF THE INVENTION

The invention relates to skill type games designed for the entertainment of the players and for developing dexterity timing and coordination for the individual players as well as competition between the players. There are various entertaining games presently available that include playing objects or projectiles of various sizes and shapes that are propelled toward a target or goal area by a number of different projecting devices.

Other games project a playing object through a playing area with the object being to contact as many targets as possible having the highest associated score; for example a "pinball" type game. This type of game also provides flipper arrangements for preventing the end of a players turn and for projecting the playing object around the playing area and the targets.

Other types of toys and games include sound actuated arrangements wherein emitted sounds control the movement of vehicles of the action of toy figures such as the release of a jack-in-the-box. Sound actuated arrangements of various types are disclosed in the following U.S. Pat. Nos. 2,957,957; 2,974,441; 2,995,866; 3,012,365; 3,061,973; 3,082,002; 3,119,201; 3,142,132; 3,192,460; 3,458,950; 3,624,962; 3,664,060, and 3,961,441.

A principal object of the present invention is to provide a new skill type game wherein the play of the game is controlled by a sound actuated arrangement.

More specifically, the invention includes a playing area and two goal areas at opposite ends of the playing area. A sound actuated flipper is provided adjacent each goal area for selectively blocking and propelling a playing object. The game players control the operation of each of the flippers by shouting or emitting other sounds in an attempt to project the playing object into the other players goal area and prevent the playing object from entering his own goal area. The sound actuated flipper arrangement includes control circuitry to provide an automatic lock-out feature to prevent sustained sounds from continually and/or continuously activating the flippers. The control circuitry of the sound actuated flipper arrangement provides a first predetermined time interval during which the flippers are operated and a second predetermined time interval within which operation of the flippers is inhibited. The playing area is defined by two relatively open areas each inclined upwardy from one of the goal areas to a center line. Each of the goal areas defines a first central opening for entrance of the playing object; the associated flipper defending the first goal opening when activated to prevent the entrance of the playing object into the associated goal area. Each of the goal areas also includes a second opening adjacent the first goal opening and a narrowed approach lane defined on the playing area. Accurate operation of the flippers propels a playing object directly into the second goal opening of the opposing goal area independent of the operation of the associated flipper.

Other objects, features and advantages of the present invention will become apparent from the following detailed description taken in conjunction with the accompanying drawings.

DESCRIPTION OF THE PREFERRED EMBODIMENT

Figure 1:
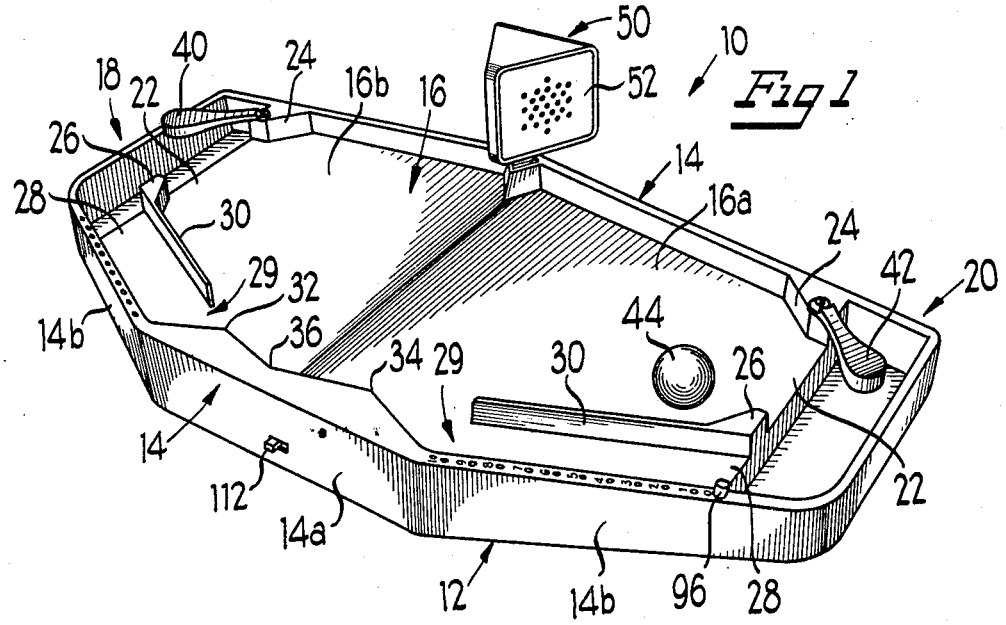
FIG. 1 is a perspective view of a skill type game embodying the concepts of the present invention.

Referring to FIG. 1, the game of the present invention, generally designated 10, includes a generally elongated housing 12 having upstanding support walls 14 on either side of the elongated housing. A playing area 16 is formed on the top of the housing 12 and includes two inclined playing area portions 16*a*, 16*b* inclined downwardly from the center of the playing area 16 toward each opposing end of the housing 12. Two goal areas generally referred to at 18, 20 are defined at opposite ends of the housing 12 and the playing area 16.

Each of the goal areas 18, 20 includes a first relatively wide, centrally disposed, goal opening 22 defined by two upstanding wall portions 24, 26. The upstanding wall portion 26 along with the adjacent sidewall 14 of the housing also defines a relatively narrow second goal opening 28 of each of the goals 22. A thin, elongated upstanding wall 30 extends outwardly from the upstanding wall portion 26 into the playing area toward the center and defines a narrow approach lane 29 to the second target opening 28. In this regard, referring to FIG. 2, the upstanding sidewall 14 along one side of the housing 12 is defined by a first central portion 14*a* and two end portions 14*b* connecting the central portion 14*a* and the target areas 18, 20. The end wall portions 14*b* of the sidewall are inclined inwardly from the center of the playing areas 16 toward the goal areas 18, 20 and are generally parallel to the upstanding walls 30 to define the approach lane 29 in the vicinity of each of the target areas 18, 20. The end wall portions 14*b* also define the overall playing area 16; the playing area portions 16*a*, 16*b* being relatively wider at the center of the playing area 16 and narrowing toward the respective goal areas 20, 18.

A flipper 40, 42 is provided adjacent each of the goal area 18, 20 to defend the goal areas and to impart motion to a playing object 44. The flippers 40, 42 are rotatably mounted to sweep an arc across the goal openings 22 of each of the goal areas 18, 20 upon actuation. When activated, the flippers 40, 42 prevent the entrance of the playing object 44 into the corresponding goal opening 22. Further, if the flippers 40, 42 are actuated at the proper time, the playing object 44 will be projected toward the opposite goal area.

The central sidewall portion 14*a* and the playing area 16 define two protruding vertical edge portions 32, 34 and an intermediate receeding edge 36 to define respective double-slopped surfaces extending into the playing area 16. Thus, the vertical edges 32 and 36 define a triangular protuberance having vertical, sloped guiding surfaces 35, 37. Similarly, the edges 34 and 36 define another triangular protuberance having vertically sloped guiding surfaces 38, 39. The sloped, guiding surfaces 35, 37, 38 and 39 enhance the action of the game and render it more difficult to project the playing object 44 into the narrowed approach path 29 and into the second target goal opening 28.

An energy responsive device 50 is carried by the sidewall 14 of the housing that is opposite the sidewall portions 14*a* and 14*b*. In one embodiment, the energy responsive device 50 is a sound receiver 50 including two apertured sound pick-up walls 52, 54 each arranged and oriented toward one of the playing area 16*a*, *b* and the goal areas 18, 20. A sound transducing element 56, for example a speaker, is enclosed within the sound receiver 50 to receive emitted sounds by the game players and to provide input signals to the flipper actuating control circuitry 60 of FIG. 5.

It should also be understood that in specific embodiments the present invention contemplates a light energy responsive device or other arrangements responsive to various forms of transmitted energy. Thus, the players transmit a specific predetermined form of energy that is received by the energy responsive device 50. In accordance with the present invention, energy transmitter devices to direct, transmit, radiate or emanate various forms of energy are provided for each of the game players.

Figure 2:
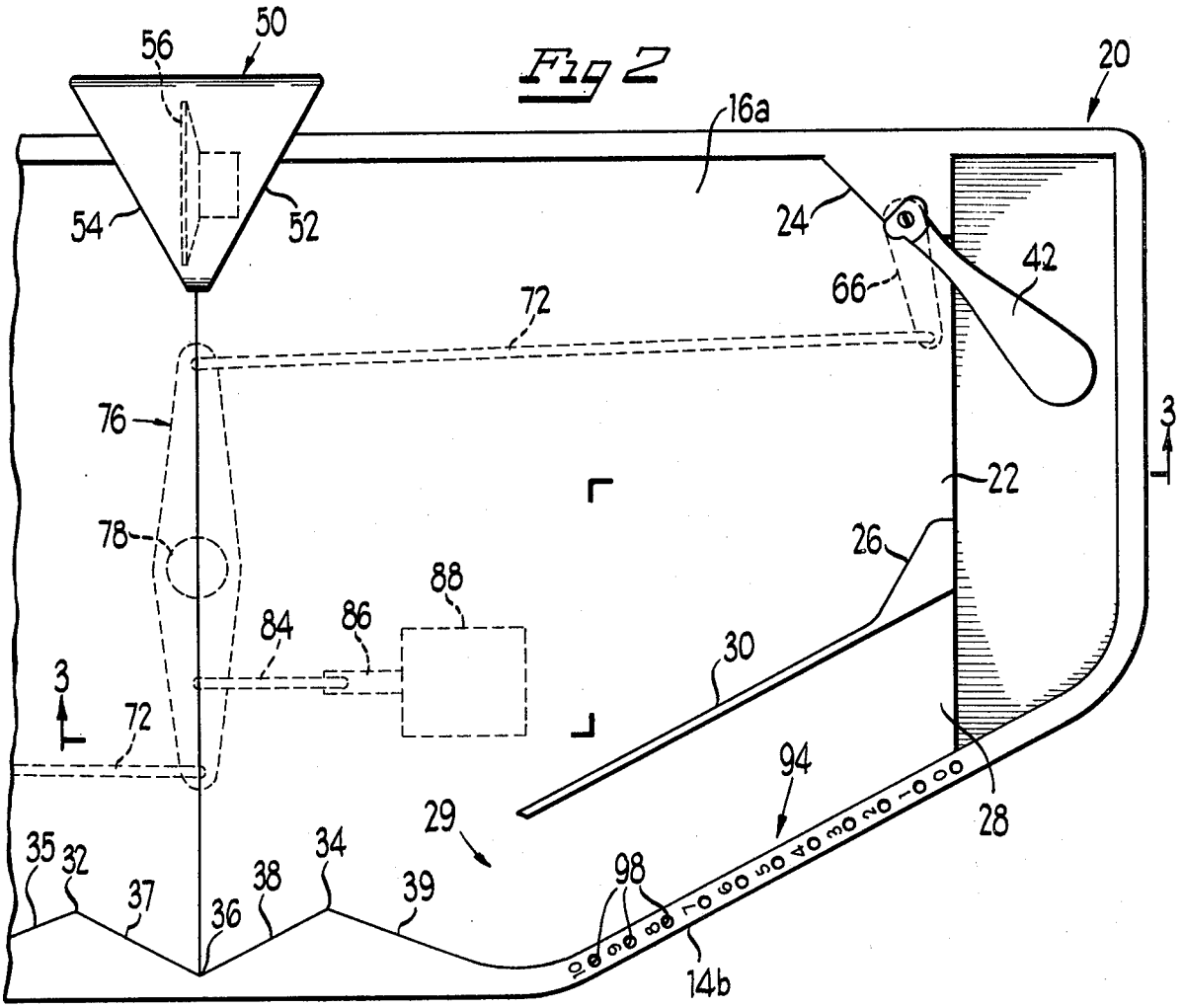
FIG. 2 is an enlarged, fragmentary plan view illustrating the goal area and the flipper actuating arrangement of a skill type game of FIG. 1.
Figure 3:
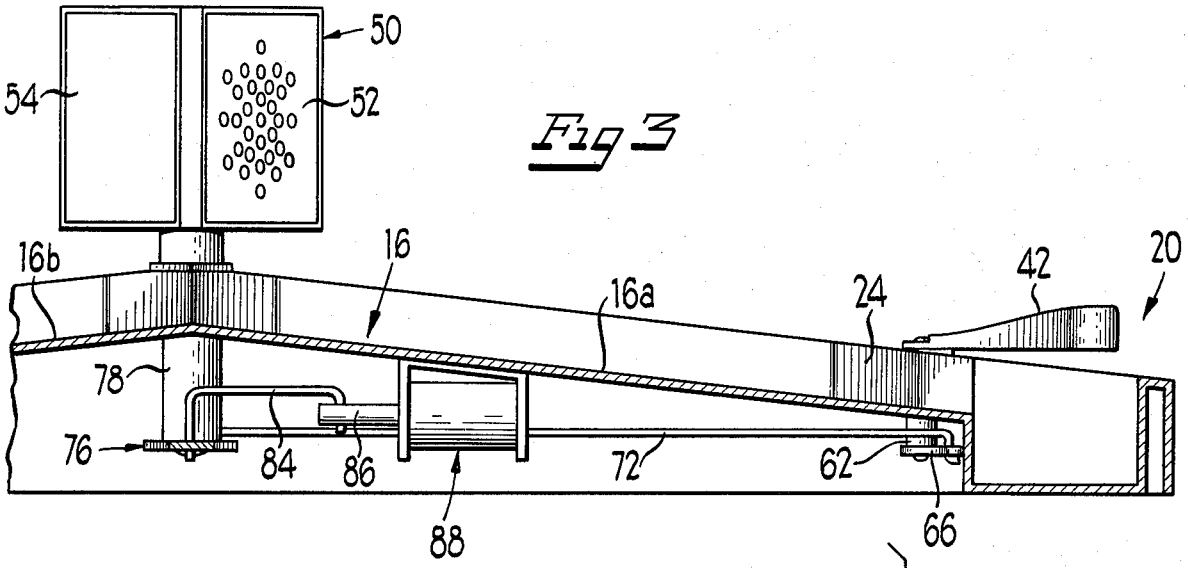
FIG. 3 is a view partly in section taken generally along the line 3—3 of FIG. 2.
Figure 4:
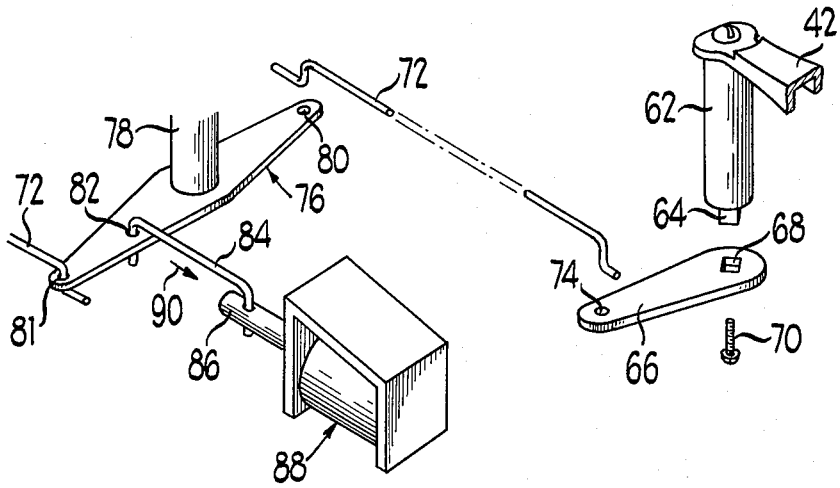
FIG. 4 is an exploded perspective view of the flipper actuating arrangement of the skill type game of FIGS. 1 through 3.

The flippers 40, 42 referring to FIGS. 2, 3 and 4, are each carried by a respective drive sleeve 62 rotatably mounted within the housing 12. The drive sleeve 62 extends through the bottom wall of the housing 12 and includes an extending drive pin 64. The drive pin 64 interfits with a receiver aperture 68 of a pivot link member 66. A suitable fastener 70 such as a screw is passed through the bottom of the pivot link member 66 through the aperture 68 and threaded into the extending drive pin 64. A drive rod 72 interfits with the pivot link member 66 through an aperture 74 at one end of the pivot link member 66. The opposite end of the drive rod 72 is connected to a drive arm 76 through an aperture 80. The drive arm 76 is carried by a central drive shaft 78 rotatably mounted in the housing 12. An identical likage arrangement is provided for the flipper 42 including a drive rod 72 interfitting with the drive plate 76 through an aperture 81 at the end of the drive plate 76 opposite the aperture 80. The drive plate 76 also includes a receiver aperture 82 near the central drive shaft 78. One end of a drive rod 84 interfits through the aperture 82 and at the other end is connected to the plunger 86 of a solenoid 88. By actuation of the solenoid 88, the drive plate 76 is rotated and the rotation transmitted to rotate the flippers 40, 42 through the aforementioned mechanism. When the solenoid 88 is actuated the plunger 86 moves into the solenoid 88 in the direction referred to at 90 to rotate the drive plate 76 in a counterclockwise direction in FIG. 4. Thus the flippers 40, 42 rotate from an unactuated position in the respective goal areas 18, 20 as shown in FIG. 2 to an actuated position to prevent entry of the playing object 44 into the goal opening 22 and to propel the playing object 44 toward the opposite goal area.

In the play of the game, the respective game players shout or emit sounds to actuate the flippers 40, 42 to prevent entry of the playing object 44 into their respective goal areas and to attempt to propel the playing object 44 into the goal of the opposing player. When a game player actuates the flippers 40, 42, the timing of the actuation and thus the timing of the emitted sound is important. The timing of the flipper actuation is important not only to prevent the entry of the playing object 44 into his goal area but also to skillfully time the flipper actuation to direct the playing object 44 as accurately as possible into either the first goal opening 22 or the second goal opening 28 of the opposite goal area. In accordance with the skill of the players, the playing object 44 is propelled into the approach path 29 of the second target opening 28 either directly or by rebounding off the guiding surfaces 35, 37, 38 and 39. When the playing object 44 is propelled into the approach path 29 by one player, the other game player cannot prevent entry of the playing object into his goal area by actuation of the flippers 40, 42.

Figure 5:
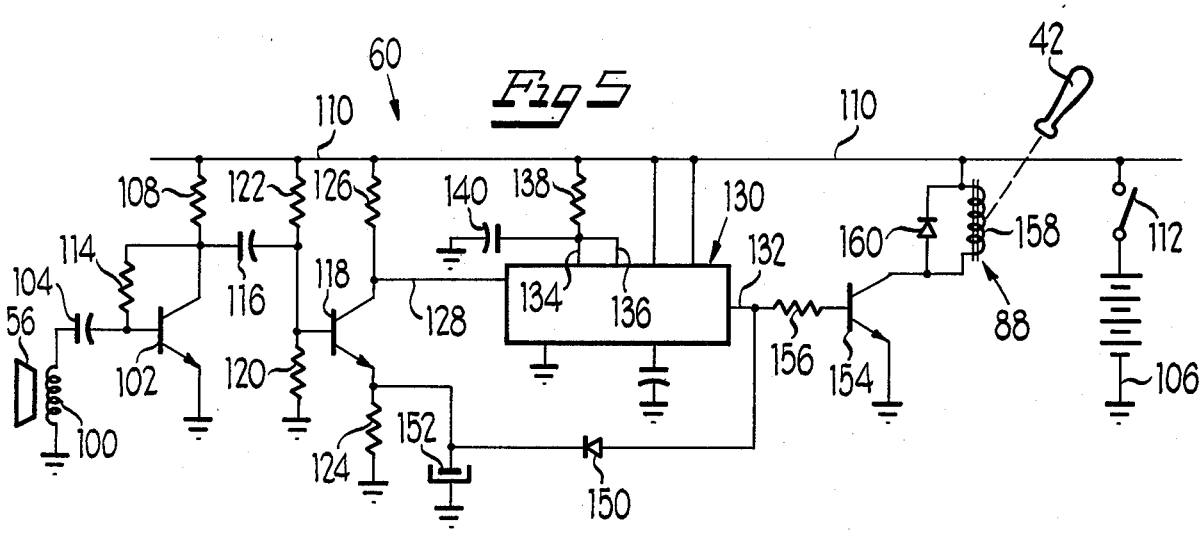
FIG. 5 is an electrical schematic drawing of a sound actuated flipper control arrangement of the skill type game of FIG. 1.

Further, the timing of the actuation of the flippers 40, 42 is important since the control circuit 60 of FIG. 5 actuates the flippers 40, 42 in response to received sound for a first predetermined interval of time of relatively short duration and inhibits or automatically locks out operation of the flippers 40, 42 for a second predetermined time interval approximately an order of magnitude greater than the first predetermined actuated time interval in a specific embodiment.

Thus, a first game player after actuating the flippers 40, 42 to propel the playing object 44 toward the goal area of a second game player may skillfully actuate the flippers 40, 42 before the playing object 44 reaches the goal opening 22. In that case, the second player cannot actuate the flippers 40, 42 to prevent entry of the playing object into his goal opening 22; the flippers 40, 42 being inhibited by the automatic lock-out time interval between the successive actuations of the flippers 40, 42.

In one scheme of play, one playing object 44 is provided and the game players proceed to actuate the flippers 40, 42. A predetermined point score is assigned to each player each time the playing object 44 enters the goal area of the opposing player. For example, the score may be kept by assigning one "goal point" each time a player scores a goal. A score tabulating arrangement 94 is provided for each player along the top edges of the housing wall 14. Specifically, a scoring indicator peg 96 is inserted into a series of holes 98 formed along the housing wall; each hole in the series being associated with a point score. Numerical indicia are disposed on the housing wall adjacent each hole. Play of the game proceeds until a game score is achieved by either player; 10 goals for example.

In other schemes of play, more than one playing object 44 is utilized to enhance the action and interest of the game.

To vary the scheme of play, a number of playing objects associated with different predetermined point scores and identified by suitable indicia such as numbers or by color are utilized; the players scoring the associated playing object point score when the playing object enters the goal area of the opposing player.

In another scheme of play, different predetermined point scores are associated with a goal score achieved by the playing object entering the goal area through the first goal opening 22 and the second goal opening 28.

In other schemes of play, the players are required to actuate the flippers 40, 42 by emitting specific sounds; for example either whistles, slapping one hand on a table surface, snapping of the fingers, clapping of the hands, or a specific tone. In this regard and in a specific embodiment, the flipper actuating control circuitry 60 is responsive to predetermined sounds in accordance with selective sound actuated arrangements. Thus, a particular phonetic sound may be required to actuate the flippers.

Referring now to the flipper actuation control circuitry 60 of FIG. 5, sounds impinging on the speaker 56 are converted to electrical impulses or signals by the speaker coil 100 of the speaker 56. One end of the speaker coil 100 is connected to the base electrode of an NPN transistor 102 through a coupling capacitor 104. The other end of the speaker coil 100 is connected to a negative reference potential generally referred to at 106. The emitter electrode of the transistor 102 is connected to the reference potential 106 and the collector electrode is connected through a resistor 108 to the switched DC power supply line 110.

The switched DC power supply line 110 is connected through an on/off switch 112 disposed on the housing 12 to the positive terminal of the DC supply source, for example a 6 volt supply connection comprising 4–1.5 volt DC battery cells.

A bias resistor 114 is connected between the base and collector electrodes of the transistor 102. Thus, the electrical signals in the speaker coil 100 in response to sounds impinging on the speaker 56 are amplified by the transistor 102. The amplified signals at the collector electrode of the transistor 102 are AC coupled through a coupling capacitor 116 to the base electrode of a second NPN transistor 118. The base electrode of the transistor 118 is connected to the negative reference potential 106 through a first bias resistor 120 and to the switched supply line 110 through a second bias resistor 122. The ratio of the bias resistors 120 and 122 is selected to bias the transistor 118 in a non-conducting state just below the bias level required for conduction of the transistor 118. The emitter electrode of the transistor 118 is connected to the negative reference potential 106 through a resistor 124 and the collector electrode is connected through the switched supply line 110 through a resistor 126.

The collector electrode of the transistor 118 is also connected to the trigger input 128 of an integrated circuit timer device 130, for example a Signetics or Texas Instrumets 555 timing circuit. The timer stage 130 produced an output pulse at an output 132 having a predetermined time duration in response to a falling edge at the trigger input 128. The threshold input 134 and the discharge timing input 136 are connected to an external timing circuit to determine the duration of the output pulse when the timer device 130 is triggered. A resistor 138 is connected between the inputs 134, 136 and the switched supply voltage 110 and a capacitor 140 is connected between the inputs 134, 136 and the negative reference potential 106. In a specific embodiment, the timing components 138 and 140 are selected to produce an output pulse duration of approximately 60 msec.

In operation, the timer 130 is triggered by amplified signals through the speaker coil 100 in response to sounds impinging on the speaker 56. The audio signal amplified by the transistor 102 drives the transistor 118 into saturation to generate a falling edge signal at the collector of the transistor 118 and to trigger the timing device 130.

Once the timer 130 is triggered and produces an output pulse at output 132, an automatic lock-out arrangement is connected between the output 132 and the emitter electrode of the transistor 118 to inhibit actuation of the flippers 40, 42 for a predetermined time interval and thus to prevent sustained or repetitive sounds from continually and/or continuously activating the flippers 40, 42; i.e. for either sustained periods of time or in extremely rapid succession. A diode 150 is connected anode to cathode from the output 132 of the timer 130 to the emitter electrode of the transistor 118 and a capacitor 152 is connected across the emitter resistor 124. Thus, when the output pulse is generated at output 132, the RC network of resistor 124 and capacitor 152 are charged through the diode 150 and the RC time constant determines the time interval during which the transistor 118 is maintained in a non-conducting state. Therefore, the transistor 118 does not respond to amplified signals at the base electrode for a predetermined time interval after the timer device 130 is triggered and produces an output pulse at 132.

In a specific embodiment, the lock-out time, the time interval during which the timer device 130 cannot be successively triggered, is approximately an order of magnitude greater than the output pulse duration. Thus, for a 60 msec. output pulse duration, the output pulses 132 are spaced by a minimum of 500 msec.; the flippers 40, 42 are activated a maximum of two times per second.

The output 132 of the timer 130 is connected to drive the base electrode of a transistor 154 through a series resistor 156. The emitter of the transistor 154 is connected to the negative reference potential 106 and the collector is connected through the solenoid coil 158 of the flipper actuating solenoid 88 to the switched supply line 110. A protection diode 160 is connected anode to cathode between the collector of the transistor 154 and the switched supply line 110.

Thus, each output pulse at 132 drives the transistor 154 into saturation; the collector to emitter junction of the transistor 154 providing a current path for the solenoid coil 158 to energize the solenoid 88 and thus the flippers 40, 42.

The foregoing detailed description has been given for clearance of understanding only and no unnecessary limitation should be understood therefrom as some modifications will be obvious to those skilled in the art.

We claim:

1. A competitive game apparatus for two or more players, comprising:

a frame defining a playing area;

means defining at least a pair of player stations at opposed locations on the playing area;

at least one playing object;

propelling means generally adjacent each of said player stations;

drive means for actuating said propelling means in a timely manner for directing the playig object generally toward the opposing player's station;

means for inhibiting operation of said drive means for a predetermined interval;

control means responsive to audible signals for energizing said drive means in response to a signal produced by a player of the game from a remote location, said control means including a sound transducing means for generating electrical impulses in response to received sounds, means for amplifying said generated electrical signals, timing means responsive to said amplifying means for actuating said drive means for a selected time interval and feedback means for initializing said inhibiting means at the end of said selected time interval whereby the players compete by alternatively actuating their associated propelling means to drive the playing piece toward an opponent.

2. The game apparatus of claim 1 wherein said propelling means comprise a pair of rotatably mounted flippers.

3. The game apparatus of claim 1 wherein each of said propelling means is actuatable for movement between a first position and a second position.

4. The game apparatus of claim 1 wherein said timing means comprises an edge triggered integrated circuit timer device and external RC timing components connected to said time device.

5. The game apparatus of claim 1 wherein said drive means comprises means for generating an output control signal for said predetermined time interval, means for transducing said output control signal to mechanical movement, and mechanical linkage means responsive to said mechanical transducing means for controlling said propelling means.

6. The game apparatus of claim 1 wherein said sound transducing means includes a speaker.

7. The game apparatus of claim 1 wherein said playing object is a ball.

8. The game apparatus of claim 1 wherein said playing area is inclined upwardly from each of said player stations toward the center of said playing area.

9. The game apparatus of claim 1 including a goal at positions on the playing area on the opposite side of the propelling means relative to the opponents propelling means.

10. A sound actuated competitive game apparatus for use by two or more players, comprising:

a frame defining a playing area;

at least two player stations on the playing area generally at opposed locations relative to one another;

a playing object;

playing object propelling means generally adjacent each of said player stations;

a goal associated with each player station on the playing area at a position on the opposite side of the propelling means relative to the opponents propelling means;

player actuatable drive means for each of said propelling means for actuating the same in a timed relationship to the movement of the playing object in an attempt to direct the playing object past the propelling means of an opponent and into a goal; and control means responsive to audible signals for energizing the drive means in response to an audible signal produced by one of the players of the game from a location remote with respect to said frame, said control means including mechanical linkage means interconnecting the propelling means for actuation of all of the propelling means simultaneously by said drive means whereby the players audibly compete in an attempt to obtain a goal by alternately actuating their associated propelling means in an attempt to direct the playing piece into a goal.

11. A sound actuated competitive game apparatus for use by two or more players, comprising:

a frame defining a playing area;

at least two player stations on the playing area generally at opposed locations relative to one another;

a playing object;

playing object propelling means generally adjacent each of said player stations;

a goal associated with each player station on the playing area at a position on the opposite side of the propelling means relative to the opponents propelling means;

a transducer for receiving audible signals from the players of the game, said transducer being mounted generally equidistant from each of the playing stations and above the playing area and including means for receiving audible signals from a plurality of opposed directions;

player actuatable drive means for each of said propelling means for actuating the same in a timed relationship to the movement of the playing object in an attempt to direct the playing object past the propelling means of an opponent and into a goal; and control means responsive to audible signals for energizing the drive means in response to an audible signal produced by one of the players of the game from a location remote with respect to said frame, said control means including means for actuating the propelling means for a first predetermined time interval and said drive means comprising means for inhibiting operation of said propelling means for a second predetermined time interval after said first predetermined time interval, said control means further comprising means for amplifying the electrical signal from said transducer, timing means responsive to said amplifying means for generating said first predetermined time interval, and feedback means for initializing said inhibiting means whereby the players audibly compete in an attempt to obtain a goal by alternately actuating their associated propelling means in an attempt to direct the playing piece into a goal.

12. The game apparatus of claim 11 wherein said timing means comprises an edge triggered integrated circuit timer device and external RC timing components connected to said timer device.

* * * * *